US008118720B2

(12) United States Patent
Sebastian

(10) Patent No.: US 8,118,720 B2
(45) Date of Patent: Feb. 21, 2012

(54) ABDOMINAL EXERCISE AND TRAINING APPARATUS

(76) Inventor: Scott M. Sebastian, Rogers, AR (US)

( * ) Notice: Subject to any disclaimer, the term of this patent is extended or adjusted under 35 U.S.C. 154(b) by 141 days.

(21) Appl. No.: 12/795,822

(22) Filed: Jun. 8, 2010

(65) Prior Publication Data

US 2011/0301002 A1 Dec. 8, 2011

(51) Int. Cl.
*A63B 26/00* (2006.01)
*A63B 71/00* (2006.01)

(52) U.S. Cl. ..... 482/140; 482/142

(58) Field of Classification Search ..... 482/51, 482/140–142, 148, 94, 93, 111–112, 130, 482/121, 907
See application file for complete search history.

(56) References Cited

U.S. PATENT DOCUMENTS

| | | | | |
|---|---|---|---|---|
| 3,191,594 | A | 6/1965 | Bagnell | |
| 4,248,420 | A | 2/1981 | Hayes | |
| 5,094,449 | A | 3/1992 | Stearns | |
| 5,419,750 | A * | 5/1995 | Steinmetz | 482/111 |
| 5,486,150 | A * | 1/1996 | Randolph | 482/133 |
| 5,545,114 | A * | 8/1996 | Gvoich | 482/140 |
| 5,681,250 | A * | 10/1997 | Hoover et al. | 482/142 |
| 5,725,463 | A * | 3/1998 | Colonello et al. | 482/140 |
| 5,743,832 | A * | 4/1998 | Sands et al. | 482/52 |
| 6,015,370 | A | 1/2000 | Pandozy | |
| 6,022,303 | A * | 2/2000 | Abdo | 482/140 |
| 6,113,522 | A | 9/2000 | Fontenot et al. | |
| 6,135,930 | A * | 10/2000 | Kuo | 482/72 |
| 6,248,047 | B1 | 6/2001 | Abdo | |
| 6,602,171 | B1 | 8/2003 | Tsen et al. | |
| 6,902,231 | B1 * | 6/2005 | Tseng | 297/27 |
| 7,137,934 | B2 * | 11/2006 | Paramater | 482/123 |
| 7,297,095 | B2 | 11/2007 | Zachary | |
| 7,455,633 | B2 * | 11/2008 | Brown et al. | 482/142 |
| 7,488,281 | B2 | 2/2009 | Weir et al. | |
| 7,507,191 | B2 | 3/2009 | Zachary | |
| 7,585,263 | B2 * | 9/2009 | Brown et al. | 482/142 |
| 7,611,445 | B2 * | 11/2009 | Brown et al. | 482/51 |
| 7,794,377 | B2 * | 9/2010 | Amzallag et al. | 482/141 |
| 7,967,733 | B2 * | 6/2011 | Abelbeck | 482/51 |
| 2006/0166799 | A1 | 7/2006 | Boland et al. | |
| 2006/0211549 | A1 | 9/2006 | Nohejl | |
| 2007/0129225 | A1 | 7/2007 | Hammer | |
| 2007/0259760 | A1 | 11/2007 | Perez | |
| 2007/0287618 | A1 | 12/2007 | Verheem | |

FOREIGN PATENT DOCUMENTS

| | | |
|---|---|---|
| WO | 2008041982 | 4/2008 |

* cited by examiner

*Primary Examiner* — Stephen Crow
(74) *Attorney, Agent, or Firm* — Stan Baker

(57) ABSTRACT

An exercise apparatus designed to specifically target the abdominal muscles is described along with a method of using the apparatus. The apparatus generally comprises four parts: a base; a seat frame attached to the base; an upper portion having a back support and handles; and a lower portion to retain the legs of a user. The apparatus allows a user to complete a typical "crunching" motion and a twisting motion encompassing both the upper torso and the lower body simultaneously. In other words the lower portion and the upper portion of the device are capable of movement about at least two distinct axes simultaneously.

20 Claims, 8 Drawing Sheets

ABDOMINAL EXERCISE AND TRAINING APPARATUS

BACKGROUND OF THE INVENTION

1. Field of the Invention

The present invention relates generally to exercise apparatus. More specifically, the invention relates to apparatus for exercising and strengthening the abdominal muscles. Particularly, the invention relates to an apparatus and method that enables a wide range of exercisers to perform training of the frontal and oblique abdominal muscles simultaneously and in a single fluid motion.

2. Description of the Related Art

There are many exercise devices designed to strengthen or increase the flexibility of specific parts of the body. Anyone who has been in a health club knows that for any body part there are several different apparatus and exercises to choose from. Of all of the body's muscles, the abdominal muscles may be the muscle group with the largest number of devices designed to aid exercise. Abdominal muscles receive so much attention for several reasons. For example, society often promotes a slim and muscular torso as an aesthetically pleasing feature. Furthermore, having strong "core" muscles (of which the abdominal muscles are a part) aids overall health by providing stability to the body and support to the back in particular.

Unfortunately, it is often difficult to train the abdominal muscles. The term "abdominal muscles" encompasses several diverse muscle groups including the obliquus externus, obliquus internus, transversus abdominis, the rectus abdominis, and the pyramidalis muscle. Isolating each muscle group can be extremely difficult and currently requires more than one exercise apparatus or exercise technique. Traditionally a person would isolate each group by repositioning the body and doing several different exercises. For example, a typical "crunch" motion where a person keeps the lower back in contact with the floor is excellent for working the rectus abdominis but does not fully engage the oblique muscles. To isolate the obliques the person may roll onto a side and then try to lift the upper torso off of the floor.

The same approach applies to apparatus assisted abdominal workouts except that a user of the apparatus has to change machines or alter the configuration of a single machine to isolate the various abdominal muscle groups. One example of such a machine is discussed in U.S. Patent Application 2006/0211549 [Nohejl]. The '549 apparatus allows a seated user to rotate the upper torso and the legs toward one another in a typical "crunch" motion while added resistance is applied to either or both of those rotative movements. This motion isolates the rectus abdominis muscles as discussed above.

The '549 device also represents a typical apparatus utilized to engage the oblique abdominal muscles. In the case of the '549 device, the seat portion may be rotated to either side of center by a few degrees and fixed in place with a pin. The portion of the apparatus engaging the upper body remains in place. Moving the legs to one side in the '549 device mimics the positioning of a crunch done on the floor when person rolls to one side and helps isolate the oblique abdominal muscles. However, the user is limited in the ability to transition from one abdominal group to the next. To exercise all abdominal muscle groups a user must choose a muscle group, adjust the machine, exercise, stop, readjust the machine, exercise, stop, readjust the machine, etc., etc.

U.S. Pat. No. 7,507,191 [Zachary] is representative of another type of device that incorporates rotational movement of upper and lower body to exercise abdominal muscles. The '191 device is limited in that although it allows movement of the upper and lower body, it only allows for rotation about a single axis—an axis generally longitudinal to the body. Other devices such as those discussed in U.S. Pat. Nos. 7,297,095 [Zachary], 6,602,171[Tsen et al], and 6,248,047 [Abdo] all provide for rotative movement of one body part (typically the upper body) while maintaining the other part (typically the lower torso or legs) in a fixed position.

The devices discussed above and other known devices all fail to allow a person to smoothly transition from one exercise targeting one abdominal muscle group to another exercise or motion that targets a separate abdominal muscle group. These devices either limit a user to abdominal rotation about a single axis at any given point in time or only allow one portion of the body (e.g., upper torso) to move while holding the other portion (e.g., lower body or legs) stationary. These limitations reduce the efficiency of an abdominal workout by restricting range of motion of the abdominal muscles and/or requiring additional time to readjust the device to target a separate group of muscles.

What is needed is an exercise device that provides a user with the ability to make a seamless transition between movements designed to target individual abdominal muscle groups. The device should allow independent and simultaneous movement of both the upper body and the lower body about two or more axes or planes. The device should also provide means of selectively increasing resistance to abdominal movement depending upon the strength of the user.

SUMMARY OF THE INVENTION

It is, therefore, a primary object of the present invention to provide an exercise apparatus that allows independent and simultaneous movement of both the upper body and the lower body about two or more axes or planes. The apparatus also provides means of selectively increasing resistance to abdominal movement depending upon the strength of the user. Furthermore, it is an object of the present invention to provide an exercise apparatus that is adjustable and useful for exercises beyond those normally employed to engage the abdominal muscle groups.

It is a further object of the invention to provide a new and novel method of exercising the abdominal muscles that allows a user to perform a typical "crunch" motion and rotational movement of the upper body and lower body simultaneously. In particular, it is an object of the invention to provide a method of exercising abdominal muscles that incorporates a typical "crunch" motion with oppositional rotative movement (e.g., rotation of the shoulders and knees in opposite directions or a "twisting" motion) or a unidirectional rotative movement (e.g., rotation of the shoulders and knees in the same direction) simultaneously.

The above objects are met by the present invention, which according to one aspect, provides an exercise apparatus for training abdominal muscles and other muscle groups. In very broad terms the device includes four elements: a base, a seat frame attached to the base, an upper portion pivotally suspended from the seat frame, and a lower portion pivotally suspended from the seat frame. The upper portion is designed to provide support to the upper torso, specifically the back, and provide handles which can be gripped by a person. The lower portion includes means to engage and retain the legs of a person. The upper and lower portions are capable of movement about at least two distinct axes (such as the movement provided by a universal joint). Such movement of the upper and lower portions can occur independently but may also occur simultaneously thereby allowing a user to adjust exercise movements to target different abdominal muscle groups without having to stop and change exercise machines or stop and alter the configuration of an exercise machine.

The present invention further provides a method for exercising a human body on an exercise device. The method includes the steps of supporting or placing a human body in a seated or generally reclined position on a seat frame and positioning the upper torso of the human body against an upper portion of the device which is pivotally attached to the seat frame. The upper portion provides support to the user's back and handles for grasping. The method continues by positioning the user's legs such that they are retained in a secure position relative to a lower portion of the device which is pivotally attached to the seat frame. The user then completes the method by using (e.g., contracting) an abdominal muscle group to rotate the upper torso of the body in a multiplanar motion while simultaneously rotating the legs and the lower portion of the device in a multiplanar motion.

BRIEF DESCRIPTION OF THE DRAWINGS

These and other more detailed and specific features of the present invention are more fully disclosed in the following specification, reference being had to the accompanying drawings, in which.

DETAILED DESCRIPTION OF THE INVENTION

In the following description, for purposes of explanation, numerous details are set forth, such as device configurations and movements, in order to provide an understanding of one or more embodiments of the present invention. Furthermore, the following detailed description is of the best presently contemplated mode of carrying out the invention based upon the existing prototype. The description is not intended in a limiting sense, and is made solely for the purpose of illustrating the general principles of the invention. The various features and advantages of the present invention may be more readily understood with reference to the following detailed description taken in conjunction with the accompanying drawings.

While the invention has been described with respect to various embodiments thereof, it will be understood by those skilled in the art that various changes in detail may be made therein without departing from the spirit, scope, and teaching of the invention. Accordingly, the invention herein disclosed is to be limited only as specified in the claims.

Figure 1:
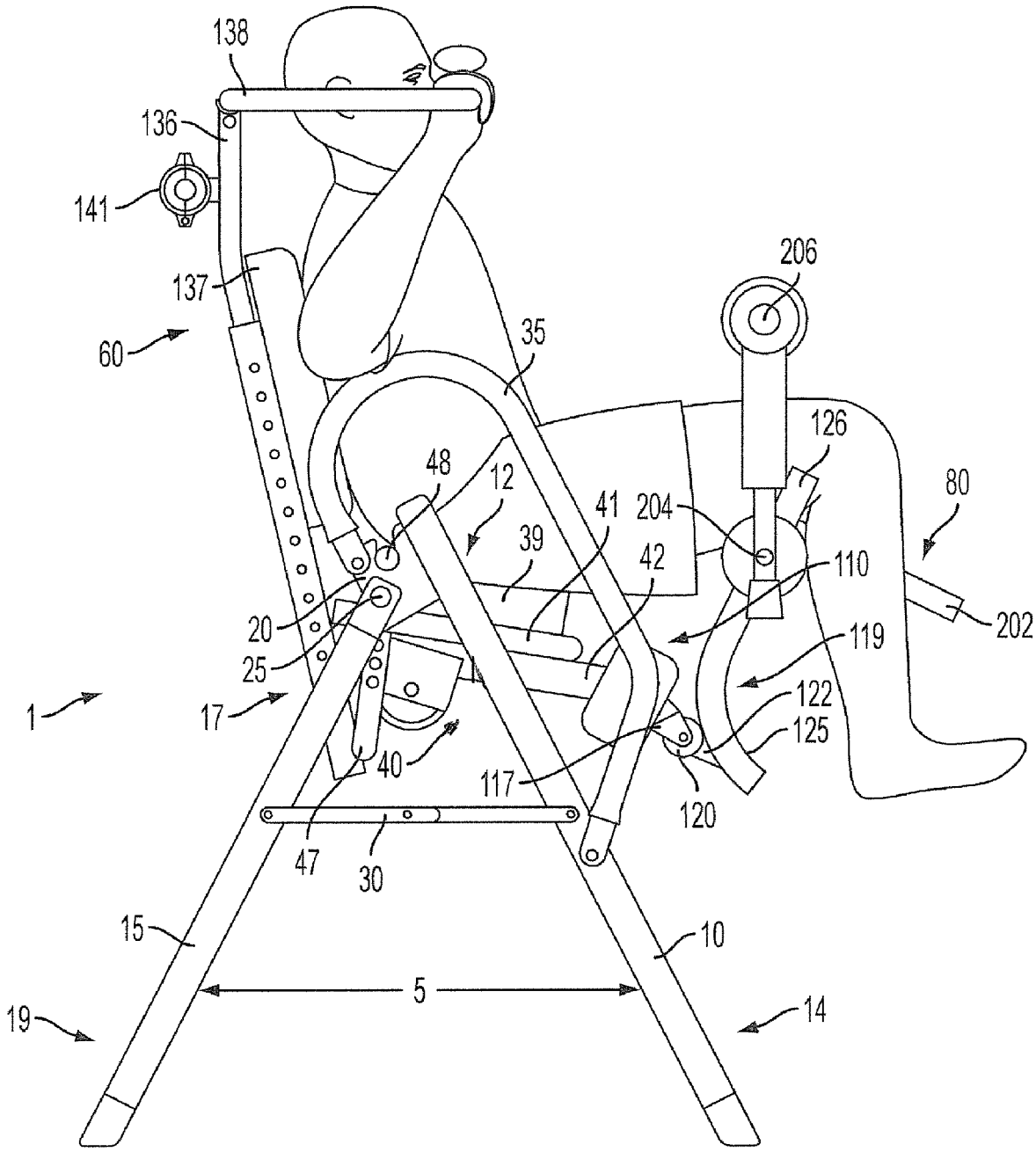
FIG. 1 shows a side view of an apparatus according to the invention during use.

Referring now to the drawings in detail, where like numerals refer to like parts or elements, there is shown in FIG. 1 an exercise apparatus 1 for training abdominal muscles. As will be discussed in more detail below, the apparatus according to the invention may be used to aid in the training of muscle groups other than the abdominal muscles such as the pectoral muscles (e.g., it can function as a weight bench) and the quadricepts (e.g, it can function as a leg extension machine). However, for purposes of this detailed description the apparatus according to the invention will be described using its abdominal functionality.

Figure 2:
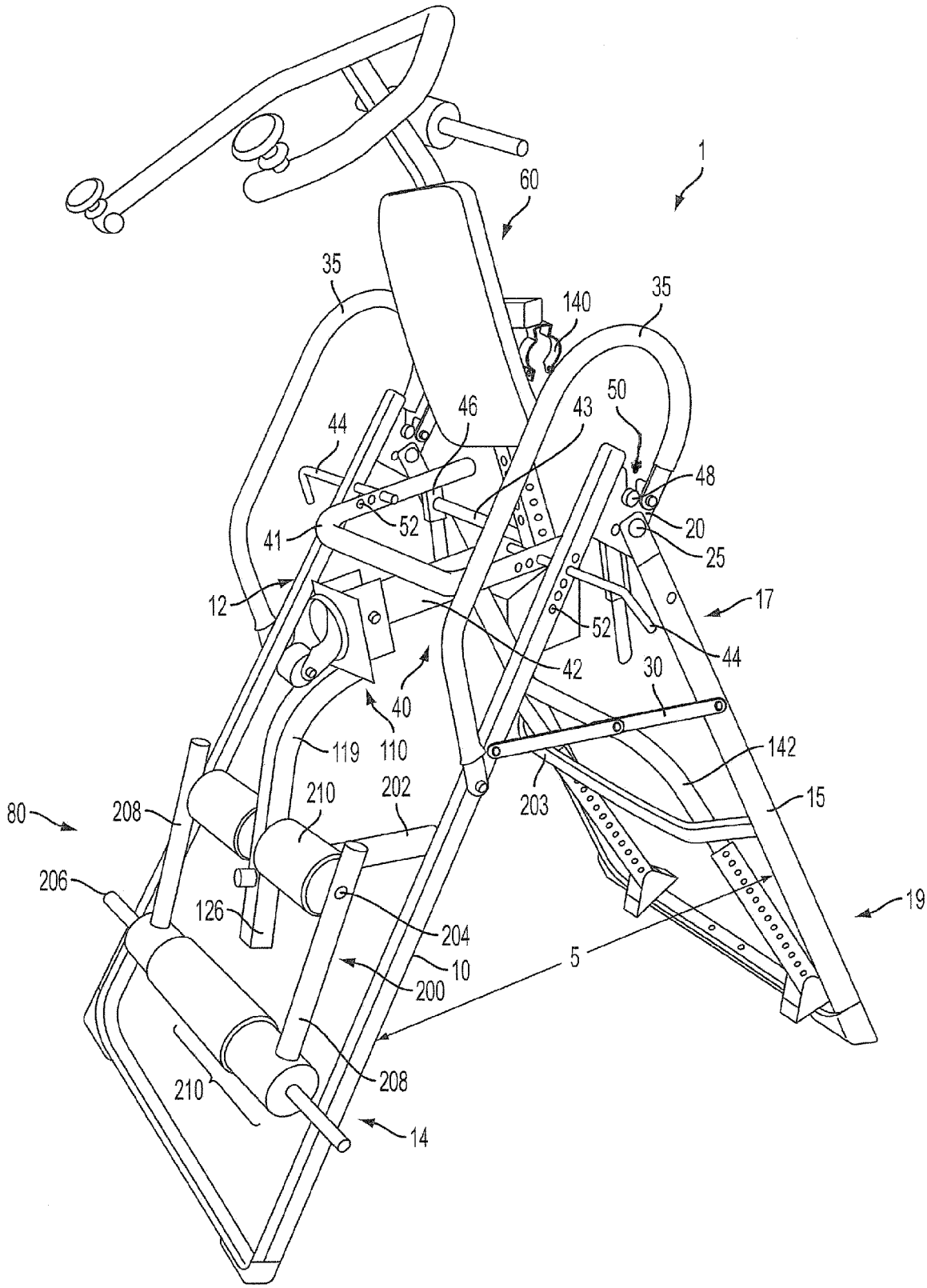
FIG. 2 shows perspective view of an apparatus according to the invention.

Turning to FIGS. 1 and 2, the exercise apparatus 1 comprises a base 5 composed of a first "U" shaped brace 10 and a second "U" shaped brace 15 similar to those used in the base of a LifeGear Inversion table such as model number 75112. The side arms of both braces mirror each other as shown in FIG. 2 thus only one side of these elements will be described herein. The first "U" shaped brace 10 comprises a proximal portion 12 and a distal portion 14. The distal portion 14 is in contact with the ground. Similarly, the second "U" shaped brace comprises a proximal portion 17 and a distal portion 19 that is in contact with the ground.

Attached to the proximal portion 12 of the first "U" shaped brace is a flange 20 having an aperture (not shown) and a notch 50. The proximal portion 17 of the second "U" shaped brace contains an aperture that can align with the aperture in the flange 20. The apertures allow pin 25 and aperture engagement of the first "U" shaped brace 10 with the second "U" shaped brace 15. The pin 25 and aperture engagement of the two braces allow them to form a stable pyramidal structure as shown in FIGS. 1 and 2. A hinged crossmember 30 is attached to both braces and is situated intermediate the proximal and distal portion of both braces The hinged crossmember 30, in conjunction with the rotational movement provided by the pin 25 and aperture engagement, allow the braces 10, 15 to collapse against one another to facilitate storage of the apparatus.

Also attached to the first "U" shaped member 10 is a rail 35 to aid a user in entering and exiting the exercise apparatus 1. The points of attachment of the rail 35 may be at several locations and not just at the flange 20 and intermediate the proximal and distal portions of the first "U" shaped brace 10 as shown in FIG. 1. Additionally, the form of the rails may vary according to design preference. For example, one could attached a hinged, straight bar to the proximal portion 12 of the first "U" shaped brace 10 to serve the same function of the rail 35 shown in FIG. 1.

The overall design of the base 5 utilized in the practice of the invention could vary considerably depending upon the design preferences of the practitioner. The primary purpose of the base 5 is to provide a stable platform for a seat portion 40 from which an upper portion 60 and a lower portion 80 are pivotally suspended.

Figure 6:
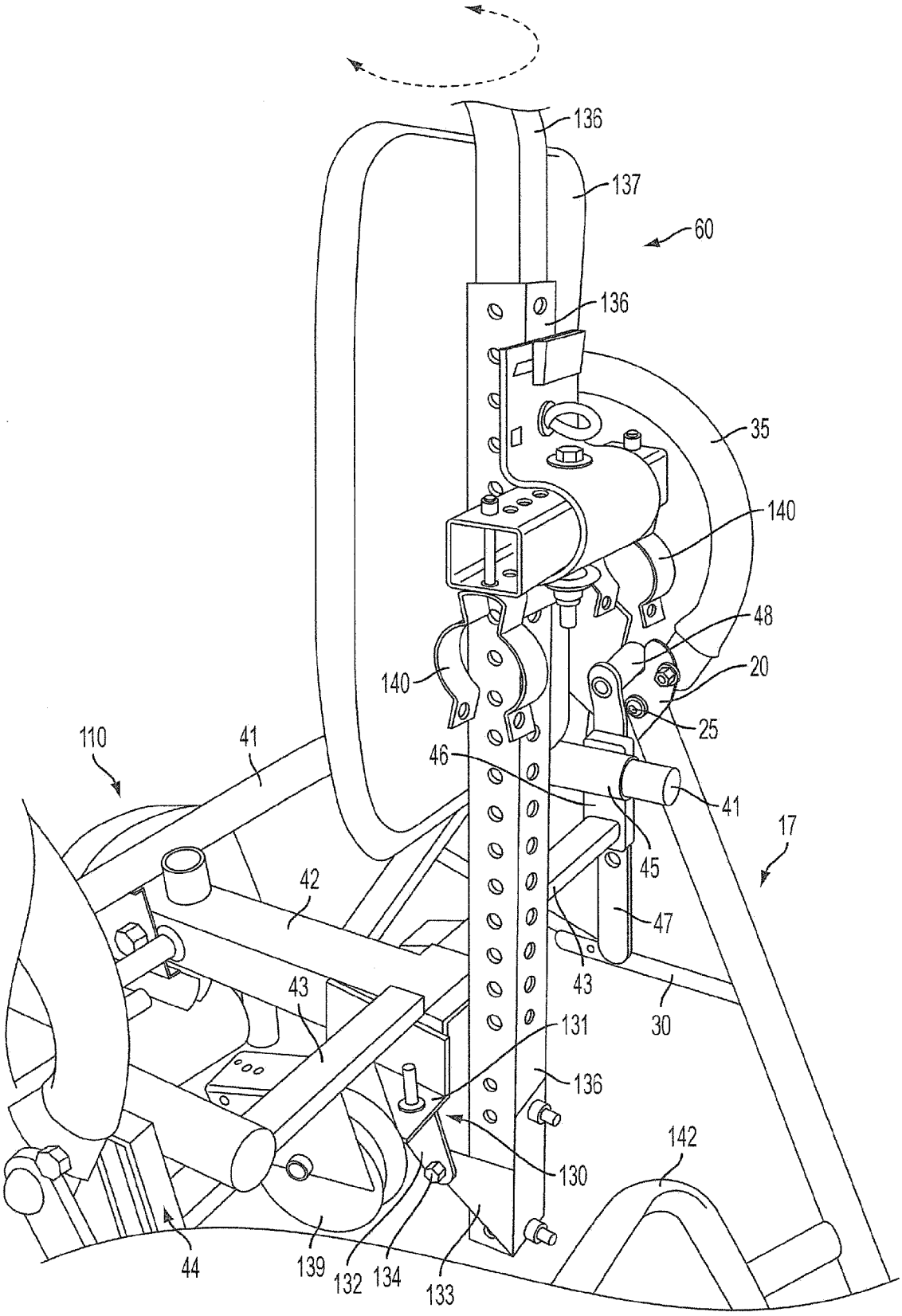
FIG. 6 shows a pivotable attachment utilized to attach the upper portion of the device to the seat frame.

Turning now to FIGS. 1, 2 and 6, the seat portion 40 comprises a support beam 42 having first and second ends where the first end is proximate the knee position of a user and the second end is proximate the tail bone of a user. First end of the support beam 42 serves as the connection point with the lower portion 80 while the second end serves as the connection point for the upper portion 60.

The seat portion 40 also comprises a seat frame 41 and a cross beam 43. The seat frame 41 is a "U" shaped metal bar (although a suitably strong polymer may also be used) where the base of the "U" extends forward toward the knees of a user. The arms of the seat frame 41 extend toward the tail bone of a user and engage with the cross beam 43 via a pair of sleeves 46.

The cross beam 43 is situated toward the second end of the support beam 42 and is of a length that is approximately the length of the base of "U" shaped seat frame 41. Fixedly attached to either end of the cross beam 43 are sleeves 46 which provide two means of connection. The first means of connection are cylinders 45 sized to mate with the arms of the seat frame 41. The second means of connection that is integral with the sleeves 46 is a channeled slot (not shown) for slidably receiving a suspension member 47. The suspension member 47 utilized in the prototype of the invention was a flat metal bar having a plurality of holes extending along its length, FIG. 1. The sides of the flat metal bar engage with channels at the edges of the sleeves which allow the bar to slide up and down with respect to the body of the sleeve 46. The side of the sleeve 46 opposite the cylinder 45 has a protruding knob which can engage and disengage with the holes contained in the suspension member 37. Thus the position of the suspension member 47 can be adjusted relative to the sleeve 46.

At the top of the suspension member 47 a rocker arm 48 extends at a right angle from the body of the suspension member 47. The rocker arm 48 is sized to fit within a notch 50 placed in the upper edge of the flange 20 which is attached to the first "U" shaped brace 10.

The rocker arm 48 engaging with the flange notch 50 is the primary means of connection between the seat portion 40 and the base 5. The rocker arm 48 and the flange notch 50 utilized in the prototype of the invention were rounded thus providing a means by which the seat portion 40 could rotate downwards under its own weight. To prevent this rotation, aligned holes 52 were drilled into the seat frame 41 and the first "U" shaped brace 10. Pins 44 were then inserted through the aligned holes 52 as shown in FIG. 2 to prevent rotation about the rocker arm 48. Preferably, a plurality of aligned holes 52 are placed in the seat frame 41 and the first "U" shaped brace 10 which would provide multiple points of insertion for the pins 44 and multiple possible angles for the seat frame. Note that the seat cushion 39 shown in FIG. 1 has been removed from FIG. 2 and FIG. 6 to show the various parts of the seat portion 40. The seat cushion 39 can be any of various standard commercially available seat cushions and may be attached to the seat portion 41 using any of the standard known means.

The above discussion regarding the seat portion 40 involved numerous parts connected by multiple means of non-permanent engagement. This particular construction of the prototype enabled a single user to take the apparatus apart for storage inside a closet or small area within a dwelling. It is envisioned that the apparatus according to the invention will be adapted for more rugged use in locations such as gyms and health clubs. Such adaptations will likely include making a modular seat portion 40 where all connections are welded or otherwise strengthened. Such adaptations are anticipated and as such fall within the scope of the invention.

Turning now to FIGS. 2, 3, 4, and 5 there is shown a pivoting connector representative of one type of pivoting connector 110 that can be utilized in the practice of the invention. Note that FIGS. 1 and 6 also show the pivoting connector 110 but the connector is covered by padding to protect the legs of the user. The padding has been removed in FIGS. 2, 3, 4, and 5 to aid in understanding this detailed description.

Figure 3:
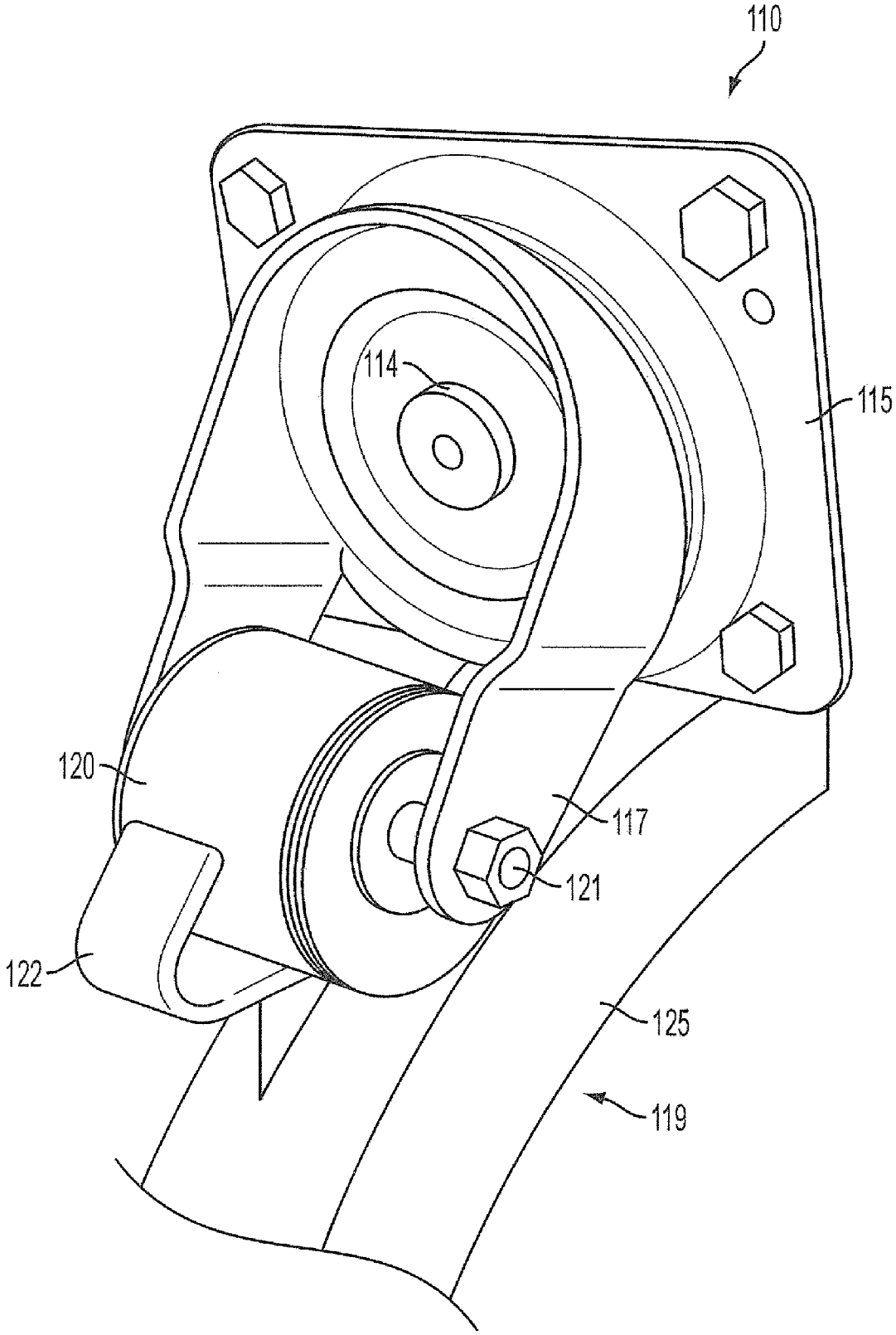
FIG. 3 shows a pivotable attachment utilized to attach the lower portion of the apparatus to the seat frame.

The pivoting connector 110 shown in FIG. 3 is the type utilized in a prototype of the invention. In broad terms, this connector 110 replicates the general functionality of a universal joint in that it allows rotational movement about multiple axes or planes simultaneously.

The connector 110 comprises four basic elements, a swivel caster 115, a rotating clevis 117, a pivot arm 119, and a bearing 120. A cross pin 121 connects the bearing 120 and pivot arm 119 to the rotating clevis 117. The swivel caster 115 and rotating clevis 117 utilized in the practice of the invention are actually an integrated unit commonly identified as a "caster". Such "casters" are commercially available and practitioners are fully capable of selecting the appropriate caster for use in the practice of the invention. Heavy duty, industrial, metal casters are preferred for use in the practice of the invention as they provide strength, safety and longevity.

The pivot arm 119 utilized in the prototype of the invention was standard square metallic tubing cut to a length suitable to provide a point of attachment of a leg engagement structure 200 (discussed in more detail below) and means for increasing resistance to movement. The pivot arm 119 is defined in part by a proximal end 125 and a distal end 126. The proximal end 125 of the pivot arm 119 utilized in the practice of the invention is defined by a slight arcuate bend as shown in FIG. 1. The bearing 120 is fixedly attached (i.e., by welded supports 122 in FIG. 4) to the pivot arm 119 at a point proximate the proximal end 125. This arrangement of attachment allows the proximal end 125 of the pivot arm 119 to rest against the bottom of the swivel caster 115 when the apparatus is not in use as shown in FIG. 3.

Figure 4:
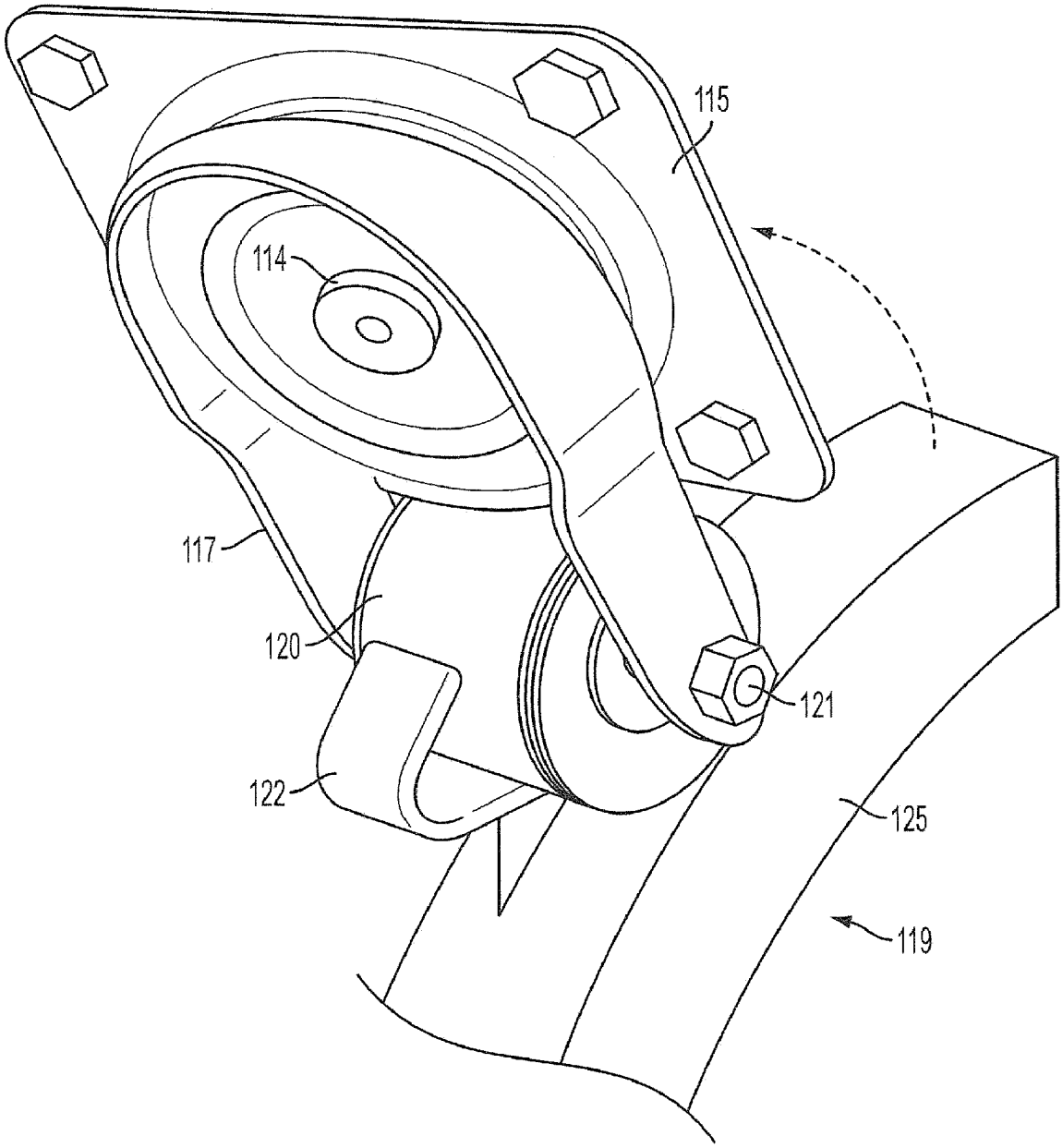
FIG. 4 shows rotational movement of the pivotable attachment of FIG. 3 about one axis.
Figure 5:
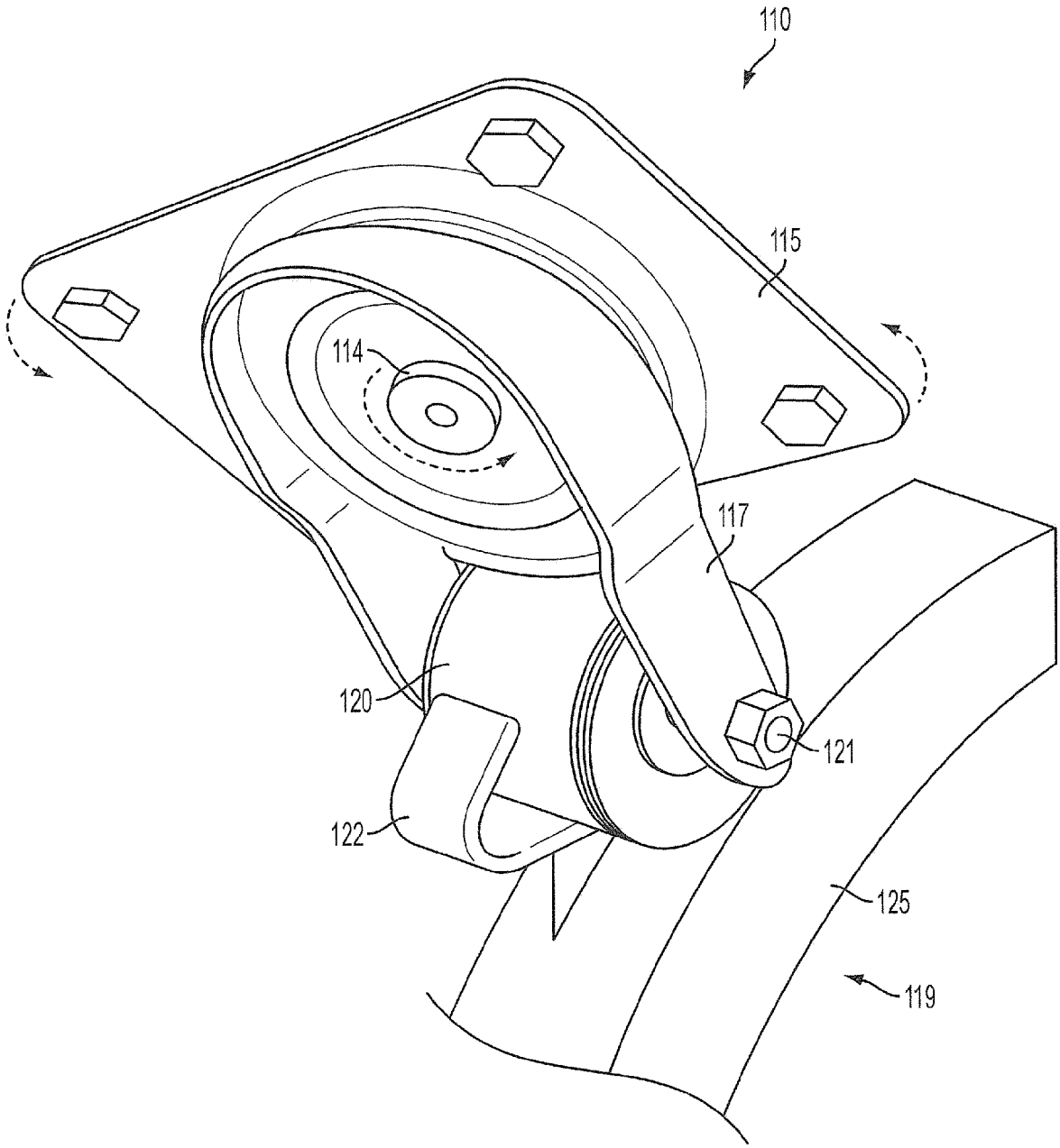
FIG. 5 shows rotational movement of the pivotable attachment of FIG. 3 about an axis different than that shown in FIG. 4

A cross pin 121 pivotally attaches the bearing 120, and thus the pivot arm 119, to the rotating clevis 117 and the swivel caster 115. This construction provides rotational movement about two axes that are substantially perpendicular to one another, where cross pin 121 represents one axis and the center 114 of the swivel caster 115 represents the other. In other words, the pivot arm 119 has functional movement in multiple planes. In particular, the pivot arm 119, and thus the lower portion 80, may rotate about two separate axes (and thus in two separate planes) simultaneously as shown in FIGS. 4 and 5. Turning to FIG. 4, the pivot arm 119 is shown to rotate about an axis which can be represented by cross pin 121. Turning to FIG. 5, the rotating clevis 117 and thus the pivot arm 119 may also rotate about an axis extending from the center 114 of the swivel caster 115.

Figure 7:
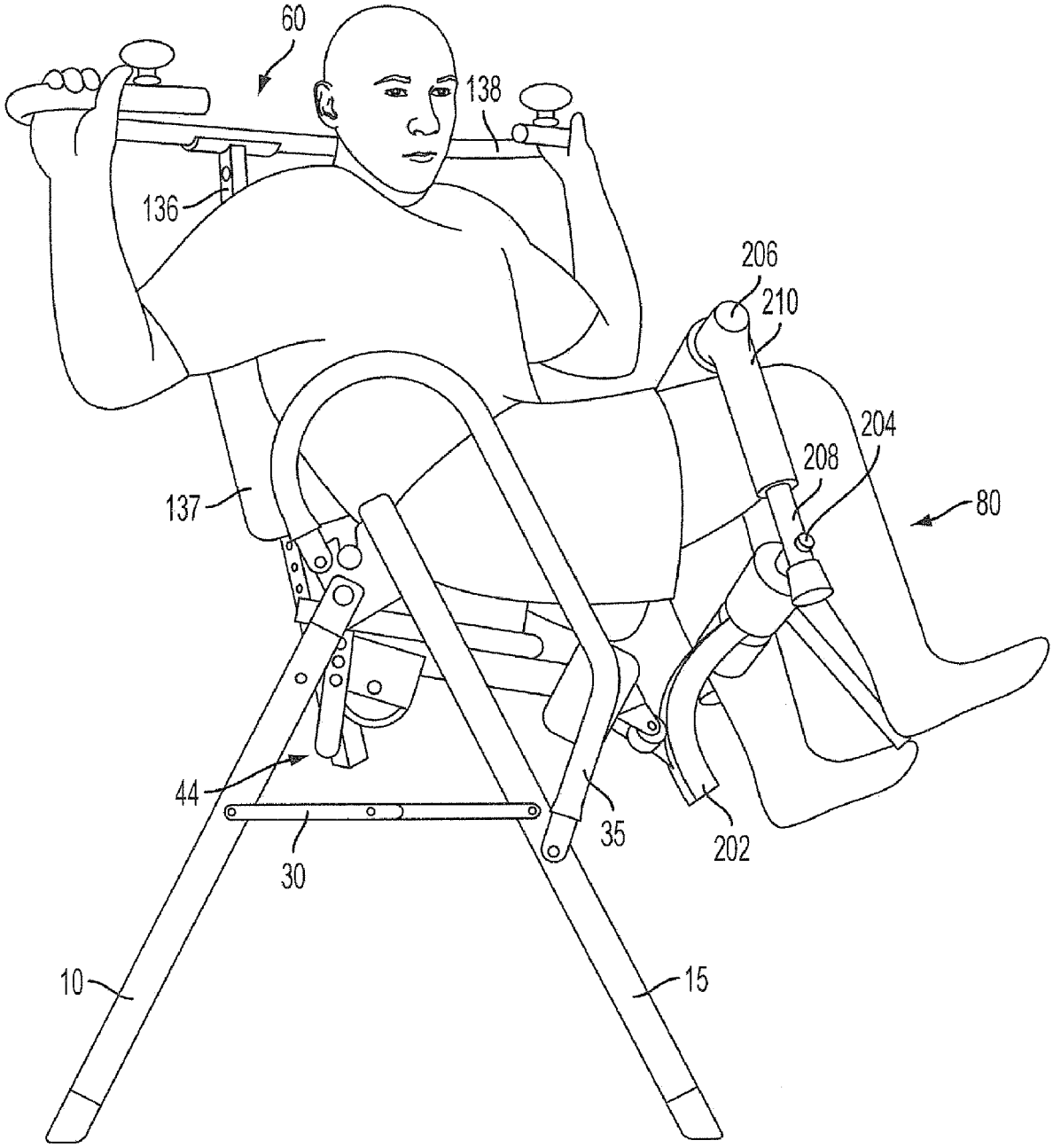
FIG. 7 is a side view of an apparatus according to the invention where a user is engaged in a twisting motion.
Figure 8:
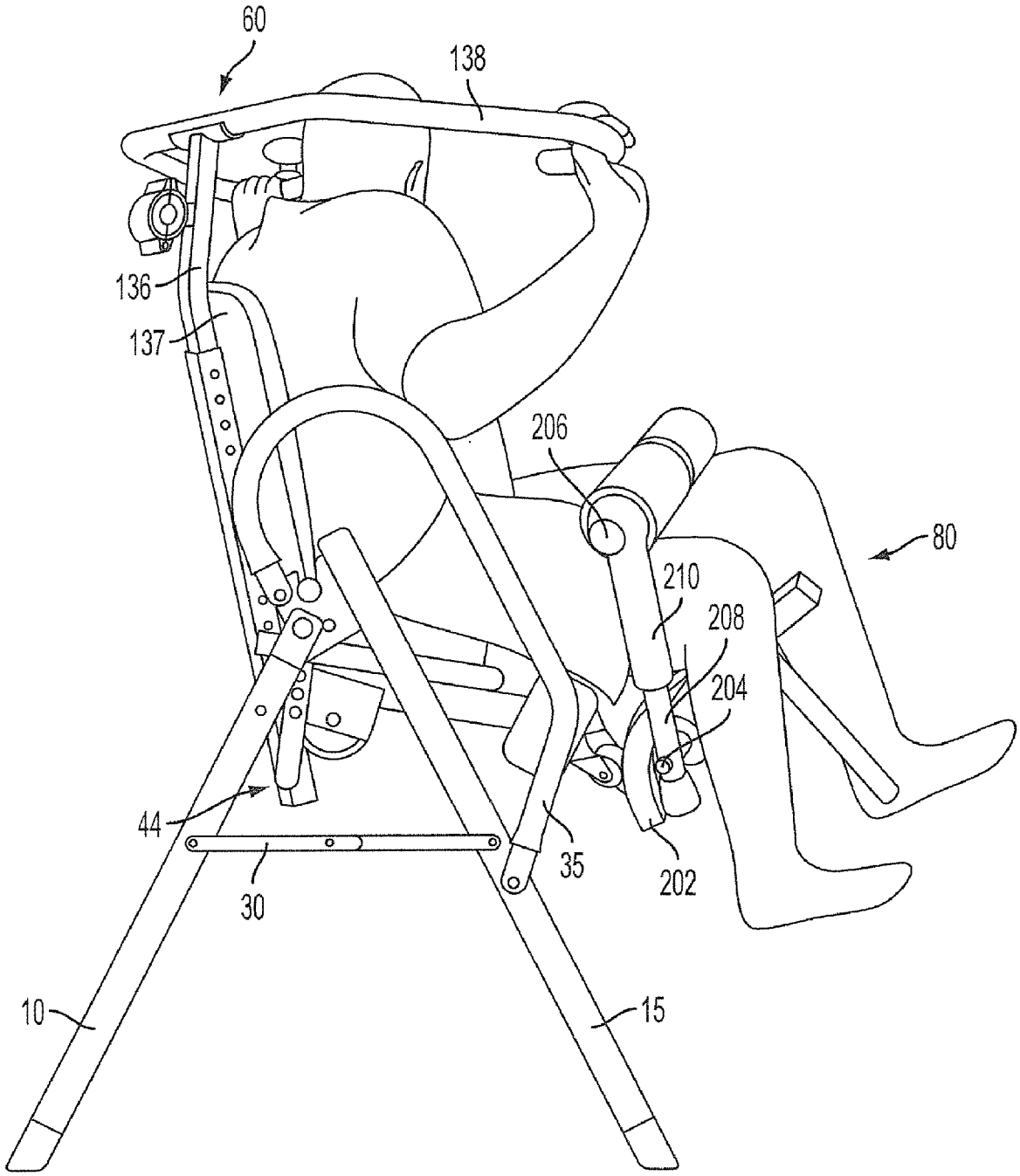
FIG. 8 is a side view of an apparatus according to the invention where a user is engaged in a twisting motion opposite to that shown in FIG. 7.

The pivoting connector 110 allows the lower portion 80 to rotate about at least two distinct axes simultaneously as shown in FIGS. 7 and 8 where a user rotates the lower portion 80 upward toward the chest and to the side.

An alternative construction not shown in the drawings but contemplated in the practice of the invention is to replace the caster based connector 110 with a ball and socket joint connector. Such connectors are commercially available and can be bolted or welded onto the front portion of the support beam 42. Those skilled in the art recognize that the geometry of the pivot arm 119 may need to be adjusted depending upon the geometry of the ball and socket joint chosen. A ball and socket joint, depending upon the model chosen, could provide a user with additional freedom of rotation to further aid in the contraction of multiple abdominal muscle groups during a workout.

Returning now to FIG. 2, the lower portion 80 of the apparatus according to the invention comprises the above mentioned pivot arm 119 and a leg engagement structure 200 attached thereto. An optional but preferred component of the lower portion is a locking bar 202 which is attached to the distal portion of the pivot arm 119. The locking bar 202 provides a means to lock the lower portion of the device in place. A chain or bar (not shown) can be attached to both the locking bar 202 and to the bracket 203 attached to the second brace 19. This arrangement locks the lower portion in place should a user desire to only utilize the upper portion of the device.

The leg engagement structure 200 provides the means by which a user secures the placement of the legs during use of the apparatus. The leg engagement structure 200 comprises a knee support bar 204, a knee retaining bar 206 and two extension bars 208 connected to and separating the knee support bar 204 and the knee retaining bar 206 by a distance. The knee support bar 204 engages with the pivot arm 119 through an aperture placed in the distal end of the pivot arm 119 (aperture not shown). The knee support bar 204 is rotatable within the aperture thus allowing the leg engagement structure 200 as a whole to pivot about knee support bar 204.

Extension bars 208 are pivotally connected to and extend from the ends of the knee support bar 204 as shown in FIG. 2. The extension bars 208 extend for a determined distance and connect (rigidly or pivotally) to the knee retaining bar 206. Both the knee support bar 204 and the knee retaining bar 206 are padded 210 for the comfort of the user. The open and generally square space created by the knee support bar 204, the extension bars 208, and the knee retaining bar 206 form an opening through which a user will place his or her legs, rotate the leg retaining structure 200 upward, pivoting about the knee support bar 204, to a position where the knee retaining bar 206 is situated above the knee and proximate the distal end of the femur, FIGS. 1, 7, and 8.

Preferably, the knee retaining bar 206 is of a length that allows it to extend beyond the connection points of the extension bars 208 as shown in FIG. 2. The extra length is provided to allow a user to add free weights to the knee retaining bar 206 thus increasing the effort required by the user. The free weights (not shown) are retained in place by known means (e.g., a spring loaded collar). It is envisioned that commercial applications of the apparatus according to the invention will replace free weights with a weight and pulley system which is common in health club weight machines and which will allow multiple users to more easily adjust the resistance during exercise.

Turning now to FIG. 6, there is a second pivoting connector 130 attached to the second end of the support beam 42 that is similar in function to the first pivoting connector 110 attached to the first end of the support beam 42. The second pivoting connector 130 is comprised of components analogous to those utilized in the first pivoting connector 110. Specifically, the second pivoting connector 130 comprises a swivel caster 131 identical to that utilized in the first pivoting connector 110. A second rotating clevis 132, identical to the one utilized in the first pivoting connector 110, is attached to the second swivel caster 131 in the standard manner. However, where the pivot arm 119 of the lower portion 80 was attached via a bearing 120 to the rotating clevis 117 and contained an arcuate bend to effectuate an approximate 90 degree angle between the lower portion 80 and the first pivoting connector 110, the upper portion 60 is connected to the second pivoting connector 130 via a pivot arm clevis 133 via a clevis pivot pin 134.

The pivot arm clevis 133 is attached via bolts to a second pivot arm 136. As shown in FIG. 6, the pivot arm clevis 133 is positioned such that the arms of the clevis extend out perpendicularly to the longitudinal axis of the second pivot arm 136. When the second pivot arm 136 is at rest as shown in FIG. 6, it is capable of movement about at least two distinct and generally perpendicular axes as was the first pivot arm 119. Specifically, the second pivot arm 136 is capable of rotation about an axis extending through the center of the second swivel caster 131 in a manner similar to that shown in FIG. 5 for the first pivot arm 119. The second pivot arm 136 is also capable of pivotal movement about an axis represented by the clevis pivot pin 134. The second pivot arm 136 and thus the upper portion 60 is capable of movement about both axes (or in two planes) simultaneously as shown in FIGS. 7 and 8. Stated alternatively, the lower portion 80 of the device is capable of multiplanar motion with respect to the seat frame 41.

As with the first pivoting connection 110, it is envisioned that a ball and socket joint (not shown) can be substituted for the second pivoting connector 130 shown in the drawings.

Looking now at the apparatus as a whole, it should be clear that the apparatus according to the invention provides for movement not yet seen in an abdominal exercise device. Specifically, the upper portion 60 is capable of movement in at least two planes simultaneously and the lower portion 80 is capable of movement in at least two planes simultaneously and the upper portion 60 and the lower portion 80 are capable of such movement simultaneously Staying with FIG. 6, the upper portion 60 of the apparatus according to the invention is comprised of additional components which aid a user in using the apparatus. Attached to the second pivot arm 136 is a back support 137 and handles 138 for grasping by a user's hands. The attachment point of the handles 138 may be at any position along the length of the second pivot arm 136 but in most instances users will prefer it to be above the shoulder level of the user when the user is sitting in the apparatus about to begin exercise.

The FIGs show other optional components that can be used to improve the quality of a user's workout and make the apparatus more functional. For example, in FIG. 6 the upper portion 60 may rotate downward about the clevis pivot pin 134 to a position approximately parallel with the floor where it can be secured using friction brackets 140 which rotate to engage with rotatable support bar 142 (FIG. 2). This arrangement of the apparatus allows upper portion 60 to function as a weight bench for additional exercises. Note that the relative height of support bar 142 can be adjusted using a two component "bar in sleeve" telescopic arrangement combined with apertures and pins. Adjusting the height of the support bar 142 allows for a plurality of different fixed elevations of the upper portion 60.

Similarly, FIGS. 1 and 6 show the second pivot arm 136 to be a similar "bar in sleeve" telescoping arrangement but the second pivot arm 136 could also be a single bar of fixed length as well. The telescoping arrangement is preferred to allow the device to be adjusted for users of varying heights. Similarly, the lower portion pivot arm 119 and/or the extension bars 208 may be constructed of telescoping tubes to provide adjustments for users of differing heights.

The pivot pin 134 also allows the upper portion 60 to rotate all the way to the ground which might be desirable for more flexible users. Current machines only allow a user to start a "crunching" motion from a seated position which limits the range of motion for the exercise to approximately 90 degrees (e.g. assuming a user can move the chest from an upright position to touching the thighs). The device according to the invention, particularly pivot pin 134, allows a user to rotate the upper body backwards beyond a vertical position thus extending the range of motion the exercise. Theoretically, a user could utilize a range of motion beyond 180 degrees if the user is flexible and strong enough.

FIG. 6 shows the upper portion 60 in what is considered its "rest position" or where most users may prefer the upper portion 60 prior to initiating exercise. As noted above, the upper portion 60 is free to rotate about pivot pin 134. Thus, in a preferred embodiment the upper portion 60 is maintained in the rest position by a tension producing device. The exact tension producing device can vary depending on the preference of the practitioner. For example, one could attach a spring from the second pivot arm 136 to the cross beam 43 of the seat portion. The prototype of the invention utilized a pair of spring loaded, wire containing reels 139 to maintain tension on the second pivot arm 136 and bias it to the "rest position". (Note: wire connections to second pivot arm 136 not shown in FIG. 6).

Other optional equipment that may be utilized in the practice of the invention includes a weight clamp 141 (FIG. 1) attached to the second pivot arm 136 to secure a dumbbell, a seatbelt (not shown) attached to the seat and possibly additional straps attached to the lower portion to further secure the lower portion to the legs. Adding a dumbbell to the upper portion via the weight clamp 141 allows a user to add resistance to movement of the upper body during training. It is anticipated that commercial versions of the apparatus according to the invention will incorporate an adjustable weight and pulley system to increase or decrease resistance in the upper portion as a user sees fit. The seatbelt and other straps such as those commonly found on other commercial devices provide a user with more stability during use.

The invention also comprises a method of exercising a human body on an exercise device. Turning to FIGS. 1, 7, and 8, the method according to the invention comprises the steps of supporting the body of a human user on a seat frame and positioning at least a portion of the upper torso of the human body against the upper portion of the device where the upper portion of the device is pivotally attached to the seat frame. The method further comprises having the user grasp handles attached to the upper portion of the device. The positioning of the user's seat and upper torso in relation to the recited components is shown in FIG. 1 utilizing a prototype of the invention discussed previously. Thus, the recited components in the method according to the invention are analogous to the components described in the description of the apparatus according to the invention (e.g., the upper portion recited in the description of the method is equivalent to the upper portion 60 described with respect to the apparatus).

The method continues with the step of positioning the legs such that they are retained in a secure position relative to the lower portion of the device which is pivotally attached to the seat frame. As noted previously, and using the apparatus of the invention as an exemplary device, this step may be accomplished by the user placing both feet within the open area created by the combination of the knee support bar 204, the knee retaining bar 206 and the extension bars 208 then rotating this combination of components about the knee support bar 204 such that the knee support bar 204 is situated beneath the knees while the knee retaining bar 206 is situated above the knees and proximate the distal femur as shown in FIG. 1. This positioning of the legs with respect to the device allows the legs to move upward and engage the knee retaining bar 206 thus lifting the lower portion of the device and any weights that may be attached to it. Note that a simple up and down movement of the legs in conjunction with the forward movement of the upper torso as shown in FIG. 1 mimics the traditional "crunch" motion that is commonly used to exercise the abdominal muscles.

However, the method according to the invention provides for movement and engagement of muscle groups beyond the movements and engagements seen in the traditional "crunch" motion. The method according to the invention also comprises using one or more abdominal muscle groups (for example, obliques) to rotate the upper portion 60 of the device and the upper torso of the body in a multiplanar motion while simultaneously rotating the lower portion 80 of the device and the legs in a multiplanar motion. In other words, the method according to the invention encompasses using a device to aid in completing simultaneous "crunch" and "twisting" motions which tend to target all abdominal muscle groups at some point during the range of motion. By using the apparatus according to the invention a user is able to increase resistance to movement and thus increase the force exerted by the user beyond that which is possible without use of the apparatus and thus increase the user's strength and muscle mass faster and more efficiently than completing the exercise motion without use of the apparatus.

FIGS. 7 and 8 demonstrate one set of twisting movements utilized in the method according to the invention. In FIGS. 7 and 8 the upper torso and the legs are rotated in opposite directions simultaneously about an axis that is generally longitudinal to the body. However, the simultaneous and multiplanar movements provided by the apparatus according to the invention also allow the upper torso and the lower torso to rotate in the same direction (i.e., unidirectionally) simultaneously about an axis that is generally longitudinal to the body.

In the drawings and specification, there have been disclosed typical embodiments on the invention and, although specific terms have been employed, they have been used in a generic and descriptive sense only and not for purposes of limitation, the scope of the invention being set forth in the following claims.

The invention claimed is:

1. An exercise apparatus for training abdominal muscles comprising:

a base;

a seat frame attached to said base;

an upper portion pivotally suspended from said seat frame, said upper portion including a back support and handles adapted to be gripped by the hands of a person;

a lower portion pivotally suspended from said seat frame wherein said lower portion additionally includes means to retain the legs of a person seated in said apparatus;

wherein said upper portion is capable of movement about at least two distinct axes and said lower portion is capable of movement about at least two distinct axes and said upper portion and said lower portion are capable of such movement simultaneously during user abdominal exercise.

2. An exercise apparatus according to claim 1 wherein said lower portion and said upper portion further comprises means for increasing resistance to movement of each portion to increase the force required by a person to move each portion.

3. An exercise apparatus according to claim 1 wherein at least one of the recited upper portion and lower portion is pivotally suspended from said seat frame using a connector having the functionality of a universal joint.

4. An exercise apparatus according to claim 1 wherein at least one of the recited upper portion and lower portion is suspended from said seat frame using a connector having the functionality of a ball and socket joint.

5. An exercise apparatus according to claim 1 further comprising an adjustable support bar for receiving said back support of said upper portion.

6. An apparatus according to claim 1 wherein the pivotal suspension of said upper portion and said lower portion allow the upper torso and legs of a person seated in the apparatus to rotate in opposite directions simultaneously.

7. An apparatus according to claim 1 wherein the pivotal suspension of said upper portion and said lower portion allow simultaneous unidirectional rotation of a person's upper torso and legs.

8. A multifunctional exercise apparatus comprising:

a base;

a seat frame attached to said base;

an upper portion suspended from said seat frame by a connector allowing multiplanar motion of said upper portion with respect to said seat frame during exercise, said upper portion including a back support and handles adapted to be gripped by the hands of a person;

a lower portion suspended from said seat frame to a connector allowing multiplanar motion of said lower portion with respect to said seat frame during exercise wherein said lower portion additionally includes means to retain the legs of a person seated in said apparatus.

9. An exercise apparatus according to claim 8 wherein said upper portion is capable of movement in at least two planes simultaneously and said lower portion is capable of movement in at least two planes simultaneously and said upper portion and said lower portion are capable of such movement simultaneously.

10. An apparatus according to claim 9 wherein said lower portion and said upper portion additionally includes means for increasing resistance to movement of each portion to increase the force required by a person to move each portion.

11. An exercise apparatus according to claim 9 wherein at least one of the recited upper portion and lower portion is pivotally suspended from said seat using a connector having the functionality of a universal joint.

12. An exercise apparatus according to claim 9 wherein at least one of the recited upper portion and lower portion is suspended from said seat using a connector having the functionality of a ball and socket joint.

13. An apparatus according to claim 9 further comprising an adjustable support bar for receiving said back support of said upper portion.

14. An apparatus according to claim 9 wherein the connector suspending said upper portion and said lower portion allow the upper torso and legs of a person seated in the apparatus to rotate in opposite directions simultaneously.

15. An apparatus according to claim 9 wherein the connector suspending said upper portion and said lower portion allow simultaneous unidirectional rotation of a person's upper torso and legs.

16. A method of exercising a human body on an exercise device comprising the steps of:

providing an exercise device;

supporting the body of a human user on a seat frame;

positioning at least a portion of the upper torso of the human body against an upper portion of the device where the upper portion of the device is pivotally attached to the seat frame while the user grasps the handles attached to the upper portion of the device with the hands;

positioning the legs such that they are retained in a secure position relative to a lower portion of the device which is pivotally attached to the seat frame; and using an abdominal muscle group to rotate the upper torso of the body in a multiplanar motion while simultaneously rotating the legs and the lower portion of the device in a multiplanar motion.

17. A method according to claim 16 wherein the upper torso and legs are rotated in opposite directions simultaneously.

18. A method according to claim 16 wherein the upper torso and legs are rotated in the same direction simultaneously.

19. A method according to claim 16 wherein the user performs a crunching motion and a twisting motion simultaneously.

20. A method according to claim 19 further comprising the step of adding resistance to increase the force required by the user to perform the crunching and twisting motions.

* * * * *